US005105962A

United States Patent [19]

Götz

[11] Patent Number: 5,105,962

[45] Date of Patent: Apr. 21, 1992

[54] TWO-PART CASE OF PLASTIC OR A SIMILAR MATERIAL ESPECIALLY FOR ACCOMMODATING BEVERAGE BOTTLES

[75] Inventor: Wilhelm Götz, Bad Wurzach, Fed. Rep. of Germany

[73] Assignee: Split-Box Patentverwertung KG, Dortmund, Fed. Rep. of Germany

[21] Appl. No.: 602,294

[22] PCT Filed: Mar. 15, 1990

[86] PCT No.: PCT/DE90/00198

§ 371 Date: Nov. 16, 1990

§ 102(e) Date: Nov. 16, 1990

[87] PCT Pub. No.: WO90/11227

PCT Pub. Date: Oct. 4, 1990

[30] Foreign Application Priority Data

Mar. 22, 1989 [DE] Fed. Rep. of Germany ..... 3909352

[51] Int. Cl.[5] ..... B65D 6/04

[52] U.S. Cl. ..... 220/23.4; 206/203; 220/513

[58] Field of Search ..... 206/144, 203, 427; 220/4.24, 23.4, 507, 509-511, 513-515

[56] References Cited

U.S. PATENT DOCUMENTS

| | | | |
|---|---|---|---|
| 2,732,969 | 1/1956 | Browne | 220/23.4 |
| 3,131,829 | 5/1964 | Masser | 206/203 |
| 3,317,081 | 5/1967 | Cornelius | 206/203 |
| 3,404,805 | 10/1968 | Stockman et al. | 206/144 |
| 3,498,523 | 3/1970 | Stembridge et al. | 206/203 |
| 3,603,474 | 9/1971 | Erickson | 220/23.4 |
| 4,328,902 | 5/1982 | North | 220/23.4 |
| 4,790,443 | 12/1988 | Auer | 206/203 |

FOREIGN PATENT DOCUMENTS

| | | | |
|---|---|---|---|
| 0048006 | 3/1982 | European Pat. Off. | 206/23.4 |
| 3404798 | 8/1985 | Fed. Rep. of Germany . | |
| 8529265 | 6/1986 | Fed. Rep. of Germany . | |

*Primary Examiner*—Jimmy G. Foster
*Attorney, Agent, or Firm*—Max Fogiel

[57] ABSTRACT

Two-part case for beverage bottles. Structure is provided on the case for mutually securing and locking the parts of the case together. The structure includes vertical assembly strips mounted on each part which slidingly interlock with each other to interlock the parts together. In addition, the structure includes pivoting bolts on the parts for preventing the assembly strips from sliding apart.

10 Claims, 3 Drawing Sheets

TWO-PART CASE OF PLASTIC OR A SIMILAR MATERIAL ESPECIALLY FOR ACCOMMODATING BEVERAGE BOTTLES

BACKGROUND OF THE INVENTION

The invention concerns a two-part case of plastic or a similar material for accommodating beverage bottles with means of mutually securing and locking the identical components that compose the case.

European Patent 0 048 006 discloses such a case. Its end user can disassemble it into its components, especially to facilitate return to the supplier, who can then reassemble it for storing and shipping the product. Each component has a hook that is inserted into another component, and there are slides that operate in conjunction with the hooks. This design is very complicated.

SUMMARY OF THE INVENTION

The object of the present invention is accordingly, with the known state of the art as a point of departure, a generic case that is easy and simple to assemble and to disassemble into its components and cost-effective to manufacture.

The object is attained in a generic case in accordance with the invention in that vertical assembly strips are mounted on each component adjacent to its interface, interlock with each other and engage the components while the case is assembled, and can be separated by sliding them to each side and in that bolts are provided that can prevent the components from sliding to each side.

The assembly strips, which are integrated into the components, and the bolts, which secure the assembled components together are sturdy enough to be easy to manufacture. The assembled case is disassembled by raising the bolts that prevent the components from sliding to each side and sliding the components along the interface to disestablish the joint. The components can then be carried around individually, one in each hand of whoever is carrying them for example. The reverse sequence—positioning the components together and bolting them into position to create the assembled case—will result in an article that can be stacked and delivered from the bottling plant to the point of sale and vice versa.

The assembly strips can be sunk into the ends of the components that accommodate the bolts in the transitional areas of the interface. The assembly strips in one preferred embodiment are mutually interlocking claws in cross-section, with one claw bent back from the end, recessed into the interface, and accessible from outside and the other claw in the same plane as the end, projecting out beyond the interface, and accessible from inside. The claws in one embodiment have jaws that taper toward the bottom and noses that accordingly taper toward the free face.

Another version of this embodiment features, preferably in the vicinity of the assembly strips, both a return that is accessible perpendicular to the interface and a mount that extends into the return and projects beyond the interface, whereby the recess interlocks with the mount and prevents the components from sliding up and down in relation to each other.

The simplest approach to locking into position the components assembled into a case are slides that travel out of the components and beyond the interface into a return on the same plane in the adjacent component.

One embodiment has carrying straps that pivot on the ends of the components and is characterized in that at last one leg of each strap has a projection that extends beyond its point of articulation with its free end extending through the assembly strip that is in front when the strap is pivoted against the component and engages the matching recess in the other component. When the projection is in the shape of a Z, the locking structures can to advantage be remote from the upper edge of the case. The carrying straps, which lock the assembled components into a position pivoted against each other while the case is assembled and provide a grip for carrying the disassembled case around when pivoted up and away from the components to disestablish the lock, constitute an ideal locking mechanism while simultaneously making the components easier to handle. The two legs of the strap in one version of this embodiment can have projections that extend beyond their point of articulation to the components, and the projection on the second leg can engage the free end of the first leg while the straps are pivoted against the assembled components.

The straps in yet another embodiment of the invention are mounted against the inner surface of the components and, when pivoted against the components, rest against the inner surface of the case.

BRIEF DESCRIPTION OF THE DRAWINGS

One embodiment of the invention will now be specified by way of example with reference to the drawings, wherein.

DESCRIPTION OF THE PREFERRED EMBODIMENTS

Figure 1:
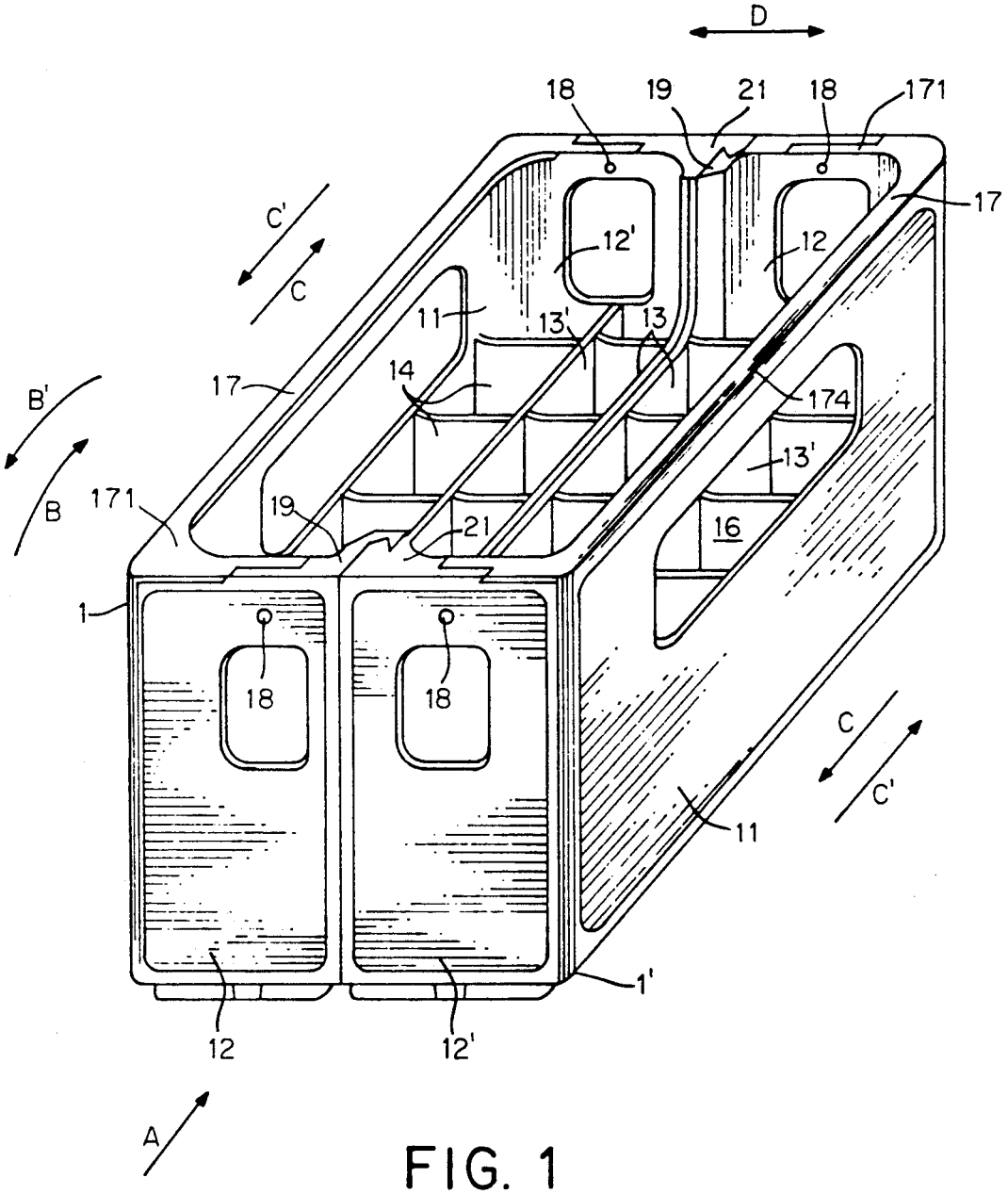
FIG. 1 is a graphic representation of the new bottle case.
Figure 2:
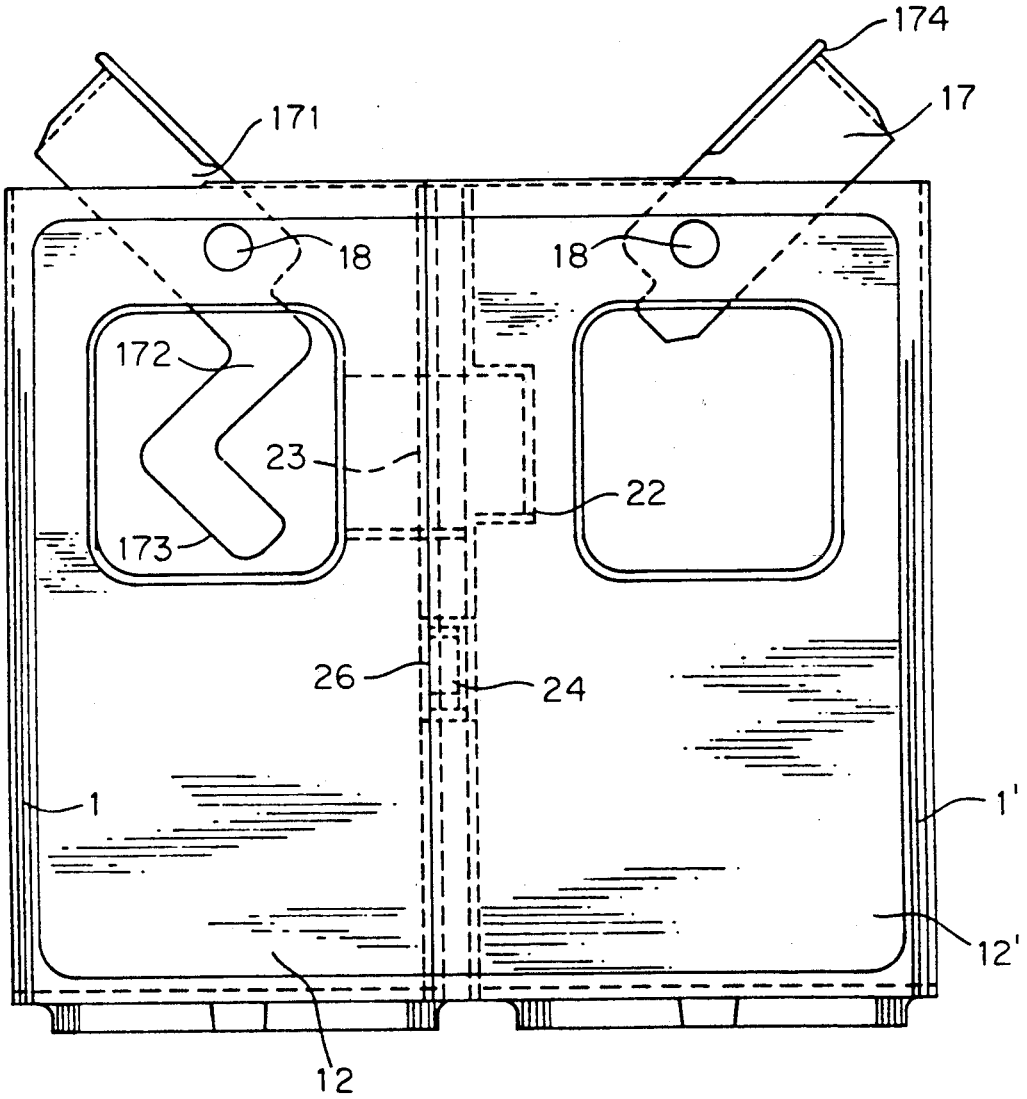
FIG. 2 is a view of the case in the direction represented by arrow A in FIG. 1 with the locking mechanism disengaged.
Figure 3:
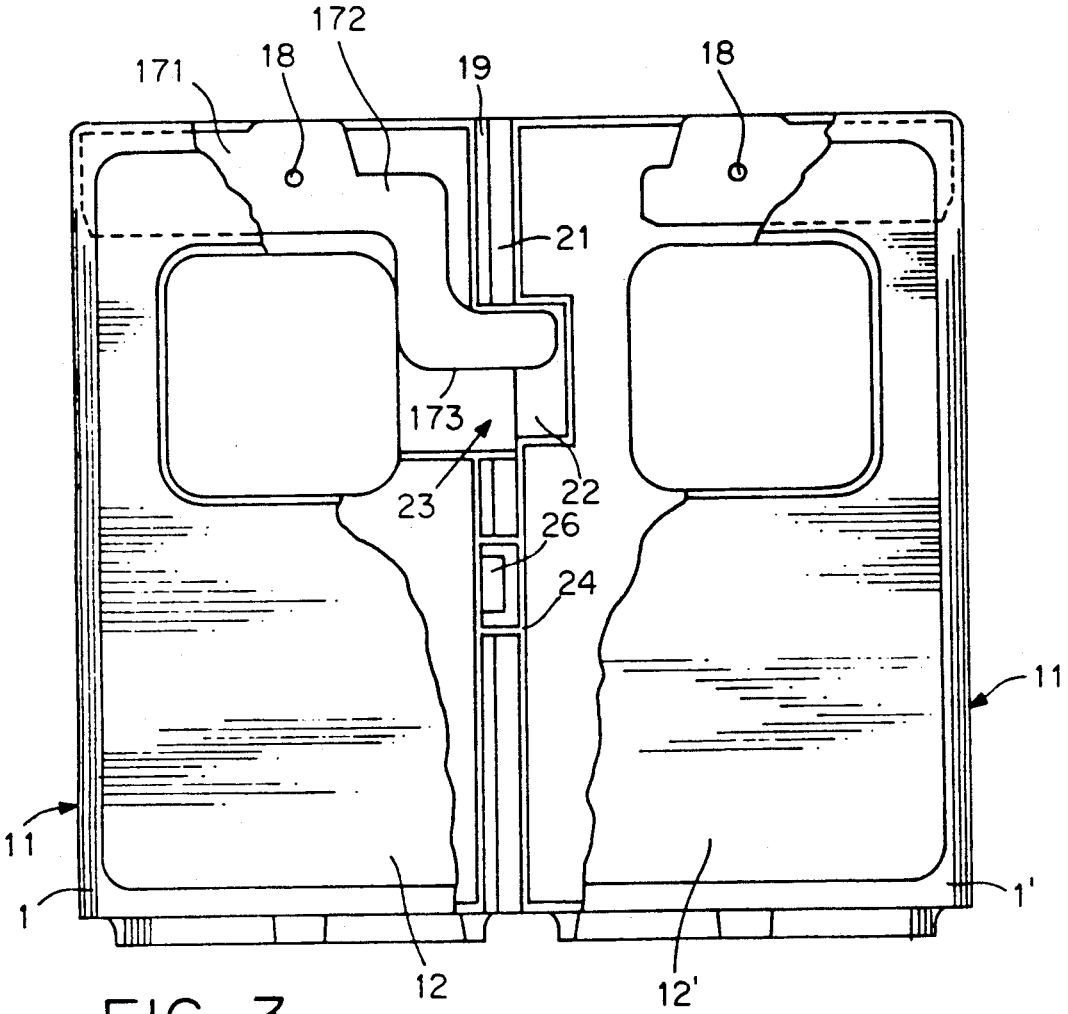
FIG. 3 is a view similar to that in FIG. 2 of the partly broken case with the locking mechanisms engaged.
Figure 4:
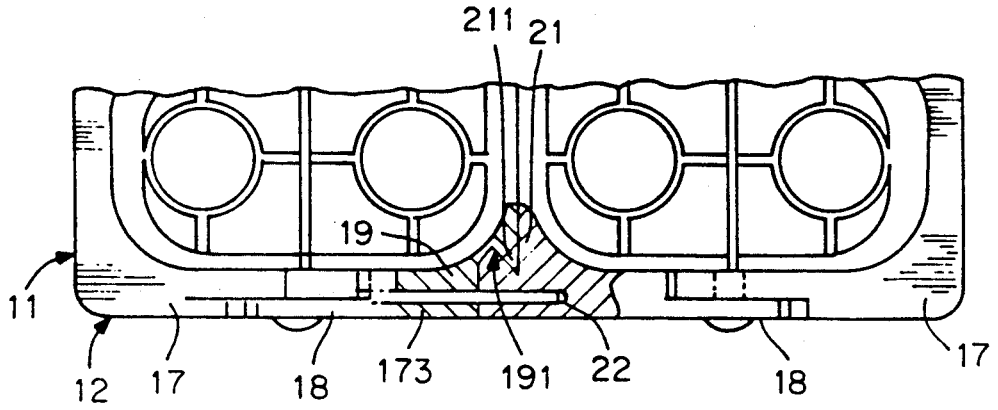
FIG. 4 is a top view of part of the case illustrated in FIG. 3 with the locking mechanisms represented in section.

A bottle-carrying case consists of identical components 1 and 1' with longer sides 11, ends 12 & 12' that constitute the shorter sides of the assembled case, and partitions 13 that extend between ends 12 & 12'. The areas enclosed by sides 11, ends 12 & 12', and partitions 13 are divided by compartments 16 that accommodate bottles for instance. Each component 1 or 1' of the case has a U-shaped carrying strap 17 that pivots on points 18 of articulation on ends 12 & 12' away from the components in the direction represented by arrow B in FIG. 1 and into the carrying position and then back against the component in the direction represented by arrow B' until its shoulder 174 comes into contact with sides 11 and ends 12 & 12'. Vertical assembly strips 19 and 21 are integrated into the components at the transition between ends 12 & 12' and partitions 13. Strips 19 and 21 fit together like claws and, once components 1 and 1' have been positioned together in the direction represented by arrow C in FIG. 1, preventing the components from separating in the direction represented by double-headed arrow D. To prevent the assembled components 1 and 1' from unintendedly separating in the direction represented by arrow C' in FIG. 1 as well, bolts 173 extend through the assembly strip 19 on components 1 and 1' and into a recess 22 in the adjacent assembly strip 21 in the corresponding component 1' or 1', securing the two components together.

Each bolt 173 in the embodiment in question is constituted by the free end of a Z-shaped projection 172 on one leg 171 of the strap 17 that extends beyond the point 18 of articulation and, when strap 17 pivots into contact with components 1 and 1', through a passage 23 in assembly strip 19 and into the recess 22 in the adjacent assembly strip 21. Security against vertical displacements on the part of the assembled components is provided by coupling structure integrated into or onto assembly strips 19 and 21 below locking mechanisms 22 and 173 in the form of a mount 26 that extends from the inner surface of the assembly strip 21 on accessible return 24 on the one hand and from the outer surface of assembly strip 19 and into return 24, which it completely occupies, on the other. To disassemble a case assembled out of components 1 and 1', straps 17 are pivoted up direction represented by arrow B, disengaging bolts 173 from the assembly strip 21 on the other component, subsequent to which the components can be separated by displacing them in the direction represented by arrow C' in FIG. 1. The straps facilitate carrying the full case from the point of purchase to the customer's automobile and thence up the elevator and into his apartment.

I claim:

1. A two-part case for holding beverage bottles comprising: two identical components; means for securing and locking said components; vertical assembly strips mounted on each component adjacent to an interface between said components and interlocking with each other for assembly of the case; said assembly strips being separable by sliding said strips to each side of said case; and bolt means on said components for preventing said components from sliding apart; carrying straps pivoting about pivot means on ends of said components; each strap having at least one leg with a projection extending beyond said pivot means with a free end of said projection extending through said assembly strips when said strap is pivoted against one component and engages the matching recess in the other component; said straps being mounted against inner surfaces of said components, said straps resting against inner surfaces of sides and ends of said case when said straps are pivoted against said component.

2. A two-part case for holding beverage bottles comprising: two identical components; means for securing and locking said components; vertical assembly strips mounted on each component adjacent to an interface between said components and interlocking with each other for assembly of the case; said assembly strips being separable by sliding said strips to each side of said case; and bolt means on said components for preventing said components from sliding apart.

3. A two-part case as defined in claim 2, wherein said assembly strips ar sunk into ends of said components mounting said bolt means in transitional areas of said interface.

4. A two-part case as defined in claim 3, wherein said assembly strips comprise intermeshing claws in cross-section, one of said claws being bent back from an end and recessed into said interface, said one claw being accessible from outside of said case, the other one of said claws being in the same plane as said end and projecting out beyond said interface, said other claw being accessible from inside of said case.

5. A two-part case as defined in claim 4, wherein said case has a bottom and an open face opposite to said bottom, said claws having jaws tapering toward said bottom and nose-shaped elements tapering correspondingly toward said open face.

6. A two-part case as defined in claim 2, including return means adjacent to said assembly strips and accessible perpendicular to said interface; and mounting means extending into said return means and projecting beyond said interface, said mounting means intermeshing with a recess for preventing said components from sliding up and down relative to each other.

7. A two-part case as defined in claim 2, wherein said bolt means is mounted on one component and deflects out and beyond said interface into a recess located on each side in the other adjacent component.

8. A two-part case as defined in claim 2, including carrying straps pivoting about pivot means on ends of said components; each one of said straps having at least one leg with a projection extending beyond said pivot means, said projection having a free end extending through said assembly strips when said one strap is pivoted against the respective component mounting said strap, said free end engaging a matching recess in the other component.

9. A two-part case as defined in claim 8, wherein said projection on said leg and extending beyond said pivot means has a Z-shape, said recess engaged by said free end extending remote from an upper edge of said case in one component when the respective strap is pivoted down against the other component.

10. A two-part case for holding beverage bottles comprising: two identical components; means for securing and locking said components; vertical assembly strips mounted on each component adjacent to an interface between said components and interlocking with each other for assembly of the case; said assembly strips being separable by sliding said strips to each side of said case; and bolt means on said components for preventing said components from sliding apart; carrying straps pivoting about pivot means on ends of said components; each strap having at least one leg with a projection extending beyond said pivot means with a free end of said projection extending through said assembly strips when said strap is pivoted against one component and engages the matching recess in the other component; said straps being mounted against inner surfaces of said components, said straps resting against inner surfaces of sides and ends of said case when said straps are pivoted against said component; said assembly strips being sunk into ends of said components, said ends mounting said bolt means in transitional areas of said interface; said assembly strip comprising intermeshing claws in cross-section, one of said claws being bent back from one end and recessed into said interface, said one claw being accessible from outside of said case, the other one of said claws being located in the same plane as said end and projecting out beyond said interface, said other claw being accessible from inside of said case; said case having a bottom and an open face opposite to said bottom, said claws having jaws tapering toward said bottom and nose-shaped elements tapering correspondingly toward said open face; return means adjacent to said assembly strips and accessible perpendicular to said interface; mounting means adjacent to said assembly strips and extending into said return means and projecting beyond said interface, said mounting means intermeshing with a recess for preventing said components from sliding up and down relative to each other; each component having said bolt means deflecting out and beyond said interface into a recess located on a side in the other adjacent component; carrying straps pivoting on pivot means on ends of said components, each strap having at least one leg with a projection extending beyond said pivot means, said projection having a free end extending through said assembly strips and engaging said recess in the other adjacent component when said strap is pivoted against the respective component; said projection on said leg and beyond said pivot means having a Z-shape, said free end of said projection engaging said recess extending remote from an upper edge of said case in one component when the respective strap is pivoted down against the other adjacent component.

* * * * *